US011473745B1

(12) United States Patent
Nolton et al.

(10) Patent No.: US 11,473,745 B1
(45) Date of Patent: Oct. 18, 2022

(54) FAUX FIREPLACE WITH SYNCHRONIZED LIGHTING

(71) Applicant: Modern Flames, LLC, Phoenix, AZ (US)

(72) Inventors: Jim Nolton, Scottsdale, AZ (US); Kris Richardson, Tempe, AZ (US); Harland Acquirre, Glendale, AZ (US); David Faszer, Gilbert, AZ (US)

(73) Assignee: MODERN FLAMES, LLC, Phoenix, AZ (US)

( * ) Notice: Subject to any disclaimer, the term of this patent is extended or adjusted under 35 U.S.C. 154(b) by 0 days.

(21) Appl. No.: 17/666,200

(22) Filed: Feb. 7, 2022

(51) Int. Cl.

| | |
|---|---|
| ***F21S 10/04*** | (2006.01) |
| ***F21V 23/00*** | (2015.01) |
| ***F24C 15/32*** | (2006.01) |
| ***F24C 7/00*** | (2006.01) |
| ***F24D 1/00*** | (2022.01) |

(52) U.S. Cl.
CPC ..... *F21S 10/043* (2013.01); *F21V 23/003* (2013.01); *F24C 7/004* (2013.01); *F24C 15/322* (2013.01); *F24D 1/00* (2013.01)

(58) Field of Classification Search
CPC ..... F21S 10/043; F21V 23/003; F24C 7/004; F24C 15/322
USPC ..... 362/92
See application file for complete search history.

(56) References Cited

U.S. PATENT DOCUMENTS

| | | | | |
|---|---|---|---|---|
| 6,050,011 | A * | 4/2000 | Hess | F24C 7/004 40/427 |
| 2004/0181983 | A1* | 9/2004 | Hess | G09F 19/12 40/428 |
| 2006/0162198 | A1* | 7/2006 | Hess | F21S 10/04 40/428 |
| 2009/0071047 | A1* | 3/2009 | O'Neill | F24C 7/004 40/428 |
| 2009/0310340 | A1* | 12/2009 | Betz | F24C 7/105 362/183 |
| 2017/0328575 | A1* | 11/2017 | Crowe | F24B 1/1808 |
| 2018/0347818 | A1* | 12/2018 | Birnbaum | F24C 7/004 |
| 2021/0372627 | A1* | 12/2021 | Walker | F21S 10/046 |
| 2022/0090751 | A1* | 3/2022 | Van Schie | G02B 30/60 |

* cited by examiner

*Primary Examiner* — Bryon T Gyllstrom
(74) *Attorney, Agent, or Firm* — Culhane Meadows PLLC; Robert Klinger

(57) ABSTRACT

A faux fireplace having synchronized lighting. The faux fireplace includes a firebox having a video display generating a colored faux flame at the back of the firebox, a faux ember bed with lighting having user selectable colors along a bottom of the firebox and in front of the video display, and down-lighting generating user selectable colors. A user input allows a user to synchronize the colors of the faux flame, the faux ember bed lighting, and the down-lighting in a setting. The user input allows the user to save a plurality of settings such that the controller generates the synchronized colors upon a single user touch. The firebox has a shallow depth such that it can be mounted in many settings, such as on the ground or inserted in a wall.

20 Claims, 17 Drawing Sheets

| | |
|---|---|
| | Power ON/OFF<br>Note: Press & Hold for 5 Seconds to Place Fireplace in Remote Pairing Mode |
| | Switches Between all Color Presets and Styles.<br>**Presets**: Style 1: Yellow(Default), Orange, Blue, Aqua, Purple, White, Style 2: Yellow(Default), Orange, Blue, Aqua, Purple, White, Style 3: Yellow(Deault), Orange, Blue, Aqua, Purple, White<br>**Displays: 1F-2F-3F-4F-5F-6F-1F-2F-3F-4F-5F-6F-1F-2F-3F-4F-5F-6F**<br>Does Not Affect Speed or Sound.<br>Note: Press & Hold for 5 Seconds to Start Connecting with APP |
| | Switches Between 10 RGB Down-Light Colors and Auto Cycle.<br>Orange,Red,Blue,Yellow,Green,Purple,Aqua,Magenta,Rose,White,<br>Autocycle Displays: 01-02-03-04-05-06-07-08-09-10-11<br>Note: Press & Hold 5 Seconds for Night Light Mode |
| | Switches Between 10 RGB Embed Bed Colors and An Auto Cycle.<br>Orange,Red,Blue,Yellow,Green,Purple,Aqua,Magenta,Rose,White,<br>Autocycle Displays: 01-02-03-04-05-06-07-08-09-10-11<br>Note: Press & Hold 5 Seconds to Turn OFF Optional Logs |
| | Heat Cycles Between OFF/Fan/Low/High. **Displays: H0--F-H1-H2**<br>Note: Press & Hold 5 Seconds to Lock/Unlock Heater &Thermostat & Wi-Fi |
| | Thermostat Cycles Through Desired Temperatures.<br>Note:Press & Hold 5 Seconds to Toggle **°C & °F. Displays Like Chart:** |

| NO | 0 | 1 | 2 | 3 | 4 | 5 | 6 | 7 | 8 | 9 | 10 | N |
|---|---|---|---|---|---|---|---|---|---|---|---|---|
| °C | 20 | 21 | 22 | 23 | 24 | 25 | 26 | 27 | 28 | 29 | 30 | C |
| °F | 68 | 70 | 72 | 74 | 76 | 78 | 80 | 82 | 84 | 86 | 88 | F |

FIG. 12

| | |
|---|---|
| | Power ON/OFF<br>Note: Press & Hold for 5 Seconds to Start Connecting with APP |
| | Modern Flames Home Button (Returns to Default Setting)<br>**Default Setting: Flame Style 1, Flame Color Yellow, Ember Bed Orange, Downlight Orange, Flame Speed Default, Sound Level1(low)** |
| | Cycles Between 3 Flame Styles. Maintain The Current Flame Color.<br>**Styles**: Flame Style 1, Flame Style 2, Flame Style 3<br>**Displays: F1-F2-F3**<br>^ Cycles Up Through the PRESENT'S of Current Flame Style<br>**Present Colors**: Yellow (Default), Orange, Blue, Green, Purple, White.<br>**Displays: 1F, 2F, 3F, 4F, 5F, 6F**<br>Does Not Affect Speed or Sound<br>v Cycles Down Through the PRESENT'S of Current Flame Style<br>**Present Colors**: White, Purple, Green, Blue, Orange, Yellow (Default)<br>**Display: 6F, 5F, 4F, 3F, 2F, 1F**<br>Does Not Affect Speed or Sound<br>**SEE BELOW FOR PRESENT DEFINITIONS.** |
| | − Decreases Flame Speed of Current Style and Color.<br>**Speeds**: Fast, Default, Slow. **Displays: 03-02-01**<br>+ Increses Flame Speed of Current Style and Color.<br>**Speeds**: Slow, Default, Fast. **Displays: 01-02-03** |
| | Switches Between 10 RGB Down-Light Colors and an Auto Cycle.<br>Orange,Red,Blue,Yellow,Green,Purple,Aqua,Magenta,Rose,White,<br>Autocycle **Displays: 01-02-03-04-05-06-07-08-09-10-11**<br>Note: Press & Hold 5 Seconds For Night Light Mode |
| | Changes Downlight Brightness Level OFF/25%/50%/75%/100%<br>**Displays: L0-L1-L2-L3-L4** |
| | Switches Between 10 RGB Embed Bed Colors and An Auto Cycle.<br>Orange,Red,Blue,Yellow,Green,Purple,Aqua,Magenta,Rose,White,<br>Autocycle **Displays: 01-02-03-04-05-06-07-08-09-10-11**<br>Note: Press & Hold 5 Seconds to Turn OFF Optional Logs |
| | Changes Embed Bed Brightness Level OFF/25%/50%/75%/100%<br>**Displays: E0-E1-E2-E3-E4** |

FIG. 13

| | |
|---|---|
| | Timer to Turn OFF Unit at Desired Time. From NO Timer to 8 Hours.<br>**Displays: 00-30-1H-2H-3H-4H-5H-6H-7H-8H** |
| | Heat Cycles Between OFF/Fan/Low/High. **Displays: H0--H1-H2**<br>Note: Press & Hold 5 Seconds to Lock/Unlock Heater & Thermostat |
| Front Top Side | Audio Buttons:<br>Top Button Raises Volume from OFF to Low to Medium to High.<br>**Displays: S0-S1-S2-S3**<br>Top Button Raises Volume from High to Medium to Low to OFF.<br>**Displays: S3-S2-S1-S0** |
| | **PRESETS DEFINED:**<br>FLAME STYLE 1<br>1F: Yellow Flame (1F), Orange Ember Bed (01), Orange Downlight (01)<br>2F: Orange Flame (2F), Red Ember Bed (02), Orange Downlight (01)<br>3F: Blue Flame (3F), Aqua Ember Bed (07), Aqua Downlight (07)<br>4F: Green Flame (4F), Yellow Ember Bed (04), Green Downlight (05)<br>5F: Purple Flame (5F), Rose Ember Bed (09), Magenta Downlight (08)<br>6F: White Flame (6F), White Ember Bed (10), White Downlight (10)<br>FLAME STYLE 1<br>1F: Yellow Flame (1F), Orange Ember Bed (01), Orange Downlight (01)<br>2F: Orange Flame (2F), Red Ember Bed (02), Orange Downlight (01)<br>3F: Blue Flame (3F), Aqua Ember Bed (07), Aqua Downlight (07)<br>4F: Green Flame (4F), Yellow Ember Bed (04), Green Downlight (05)<br>5F: Purple Flame (5F), Rose Ember Bed (09), Magenta Downlight (08)<br>6F: White Flame (6F), White Ember Bed (10), White Downlight (10)<br>FLAME STYLE 1<br>1F: Yellow Flame (1F), Orange Ember Bed (01), Orange Downlight (01)<br>2F: Orange Flame (2F), Red Ember Bed (02), Orange Downlight (01)<br>3F: Blue Flame (3F), Aqua Ember Bed (07), Aqua Downlight (07)<br>4F: Green Flame (4F), Yellow Ember Bed (04), Green Downlight (05)<br>5F: Purple Flame (5F), Rose Ember Bed (09), Magenta Downlight (08)<br>6F: White Flame (6F), White Ember Bed (10), White Downlight (10) |

FIG. 14

FAUX FIREPLACE WITH SYNCHRONIZED LIGHTING

TECHNICAL FIELD

The present disclosure relates to faux fireplaces that generate realistic faux flames for homes, apartments and other confined locations.

BACKGROUND

Faux fireplaces are commonly used in personal homes, condominiums, apartments and the like to generate a faux (synthetic or simulated) flame when a real wood burning fireplace is not allowable or preferred. Typical faux fireplaces include electric and gas burning fireplaces.

This disclosure includes a faux steam-based fireplace designed to eliminate the challenges and disadvantages commonly associated with gas fireplaces without compromising the realism of the flames.

BRIEF DESCRIPTION OF THE FIGURES

FIG. 12 illustrates the buttons of the control panel in the left column with their assigned functions in the right column; and FIG. 13 and FIG. 14 illustrate the buttons of the touch display in the left column and their assigned functions shown in the right column.

DETAILED DESCRIPTION

This disclosure includes a faux fireplace having synchronized lighting. The faux fireplace includes a firebox having a video display generating a colored faux flame at the back of the firebox, a faux ember bed with lighting having user selectable colors along a bottom of the firebox and in front of the video display, and down-lighting generating user selectable colors. A user input allows a user to synchronize the colors of the faux flame, the faux ember bed lighting, and the down-lighting in a setting. The user input allows the user to save a plurality of settings such that the controller generates the synchronized colors upon a single user touch. The firebox has a shallow depth such that it can be mounted in many settings, such as on the ground or inserted in a wall.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

The term "coupled" as used herein refers to any logical, optical, physical or electrical connection, link or the like by which signals, or light produced or supplied by one system element are imparted to another coupled element. Unless described otherwise, coupled elements or devices are not necessarily directly connected to one another and may be separated by intermediate components, elements or communication media that may modify, manipulate or carry the light or signals.

Figure 1A:
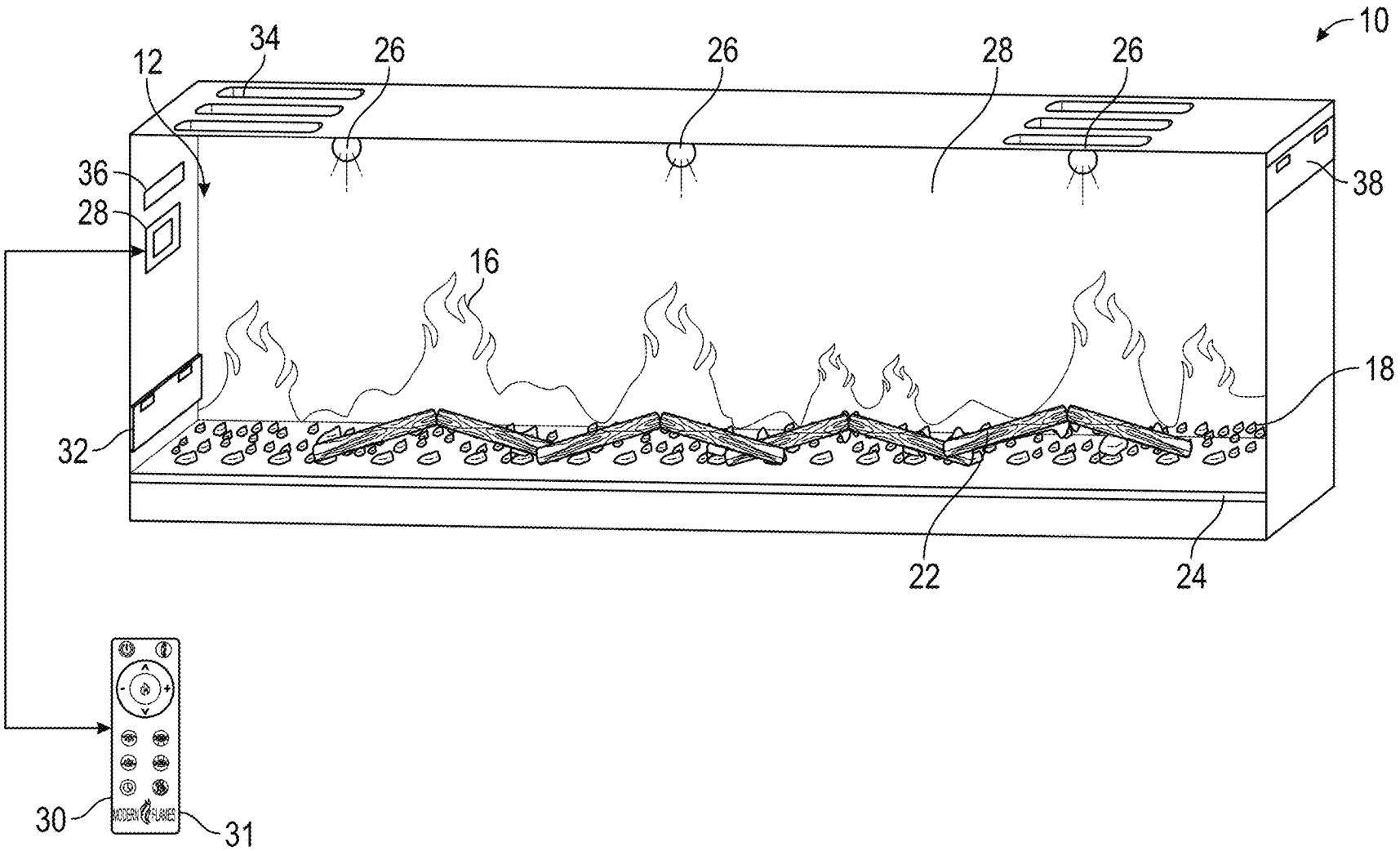
FIG. 1A illustrates a perspective front view of the faux fireplace including a video display generating a displayed faux flame, ember bedding, and down-lighting.
Figure 1B:
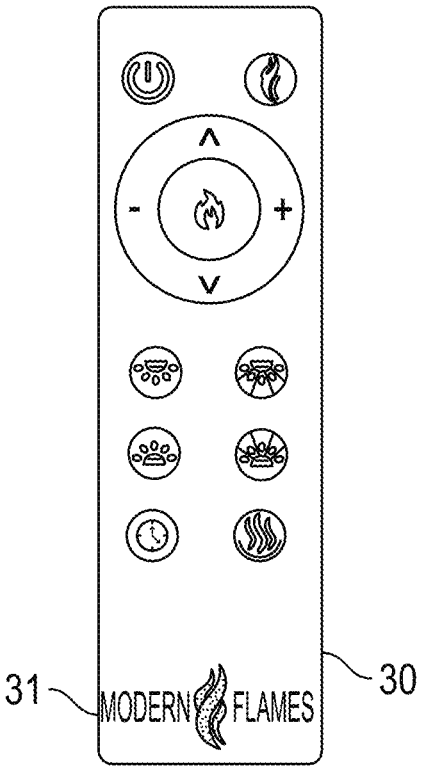
FIG. 1B illustrates a remote control with control buttons, which buttons are also provided on the control panel.
Figure 2:
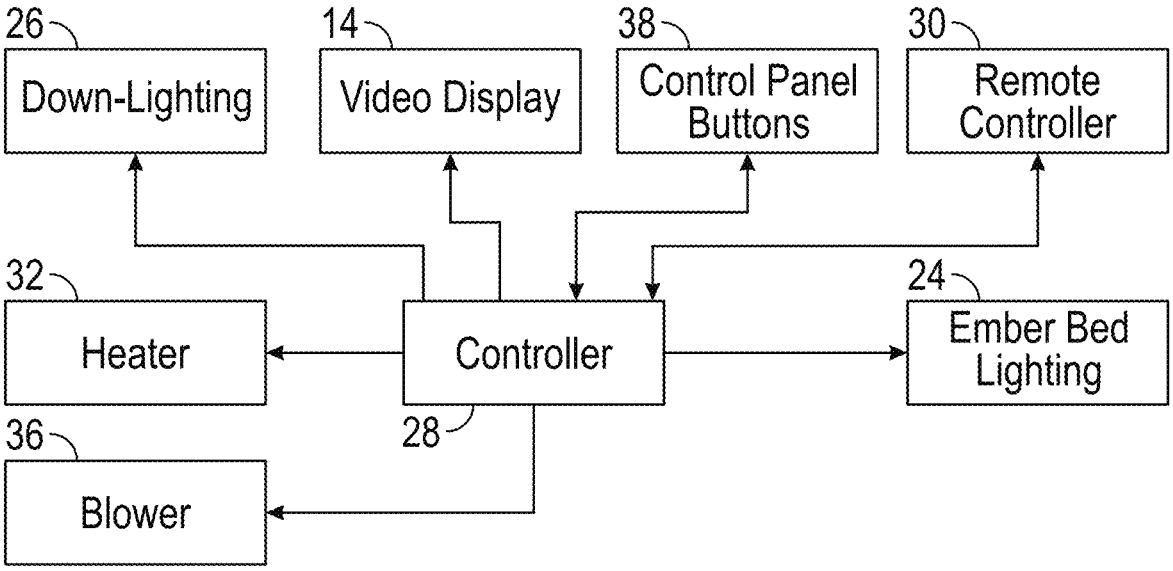
FIG. 2 illustrates a block diagram of the faux fireplace.
Figure 3:
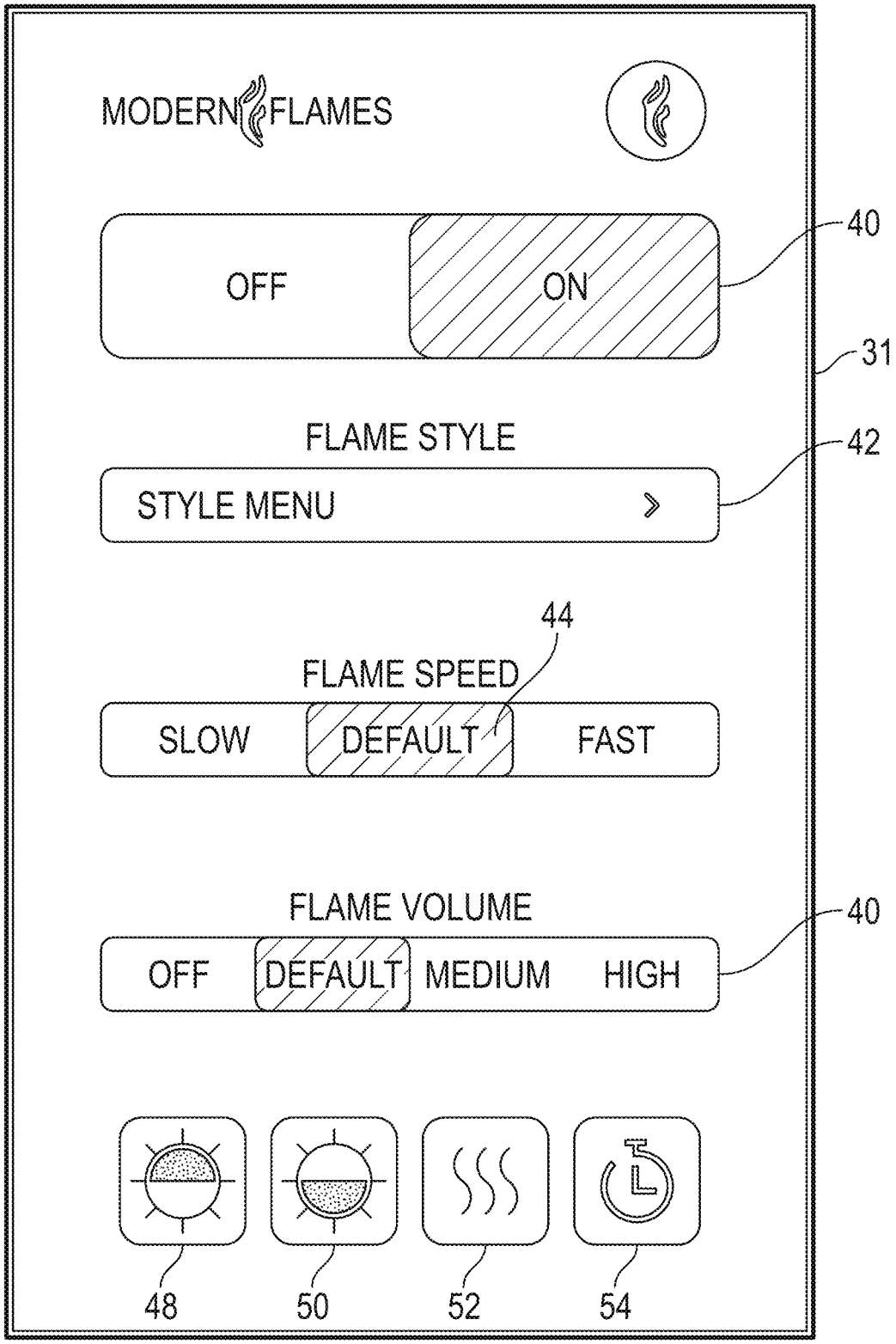
FIG. 3 illustrates a view of a remote control having a style menu region configured to control the synchronization of the colored lighting.

Referring to FIG. 1A there is illustrated a faux fireplace 10 having a chassis referred to as a firebox 12 including a vertically extending electronic video display 14 configured to display looping video of a faux flame shown at 16. The video display 14 may be formed by two or more panels to create a larger and horizontal faux flame. The faux fireplace 12 is configured as an insert that can slide directly into an opening in a wall, such as between studs and surrounded by drywall, and has a rather shallow depth, such as 6 inches, and includes a faux ember bed 18 at the firebox bottom 20 extending forwardly from the video display 14. The ember bed 18 is covered by a media, such as glacier crystals, and includes a plurality of resin faux logs 22 positioned on the ember bed 18. Ember bed lighting 24 is positioned under the ember bed 18 and is configured to selectively illuminate the ember bed 18 and faux logs 22 with a selectable color. Down-lighting 26 at the top of the firebox 12 is configured to selectively illuminate the firebox 12 from above at a user selectable color. The color of the faux flame 16, the ember bed lighting 24 and the down-lighting 26 is selectively controlled by a controller 28 that is remotely controllable by user using a wireless input device 30, such as a remote control as shown in FIG. 1B. In an example, the remote control 30 is a mobile device with the touch display controlled by an application, as shown in FIG. 3. The ember bed lighting and the down-lighting may be created by a liquid crystal display (LCD), a light emitting diode (LED), or the like. The lighting may be comprised of red/green/blue (RGB) lighting. The firebox 12 includes a heater 32 configured to generate radiant heat, and vents 34 configured to emit the generated heat using a blower 36. The faux fireplace 10 is also controllable by a plurality of control panel 38 having buttons located on an upper right corner of the firebox 12.

The ember bed 18 may be formed of a plastic (e.g., Polystyrene or Acrylic) ember bed screen (white color) acting as a diffusion material for the underlaying ember bed lighting 24. The glacier crystals are laid on top of the ember bed screen to emulate a glowing ember bed of an actual fireplace. The ember bed lighting 24 is positioned appropriately as to not create bright and dim spots on the ember bed screen. The firebox 12 may have a colored glass viewing window 38, such as a tea color, such as tempered glass with sanded edges. The controller 28 includes memory with a video file(s) for generating the looping video of the faux flame 16, which memory may be removable such as a thumb drive.

The buttons of the control panel 38 are shown in the left column of Table 1 below with their assigned functions shown in the right column.

The touch display 31 of the remote control 30 is illustrated in FIG. 1B, and it has some similar buttons that are also found in the control display 38. The buttons of the touch display 31 are shown in the left column of Table 2 and Table 3 below with their assigned functions shown in the right column.

Figure 4A:
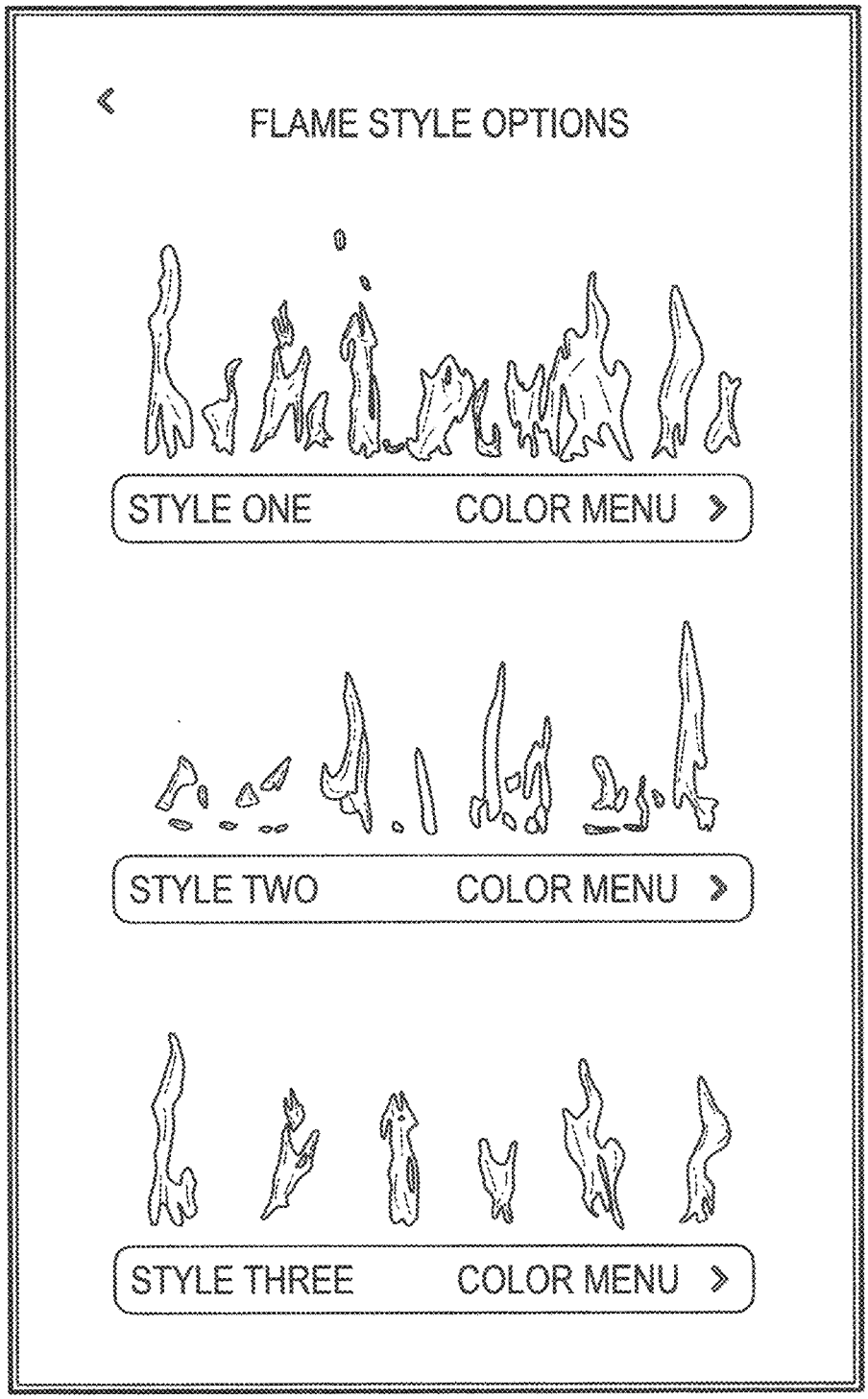
FIG. 4A-4D illustrates the style menu options for selecting multiple styles of faux flames and the color of the faux flames.
Figure 4B:
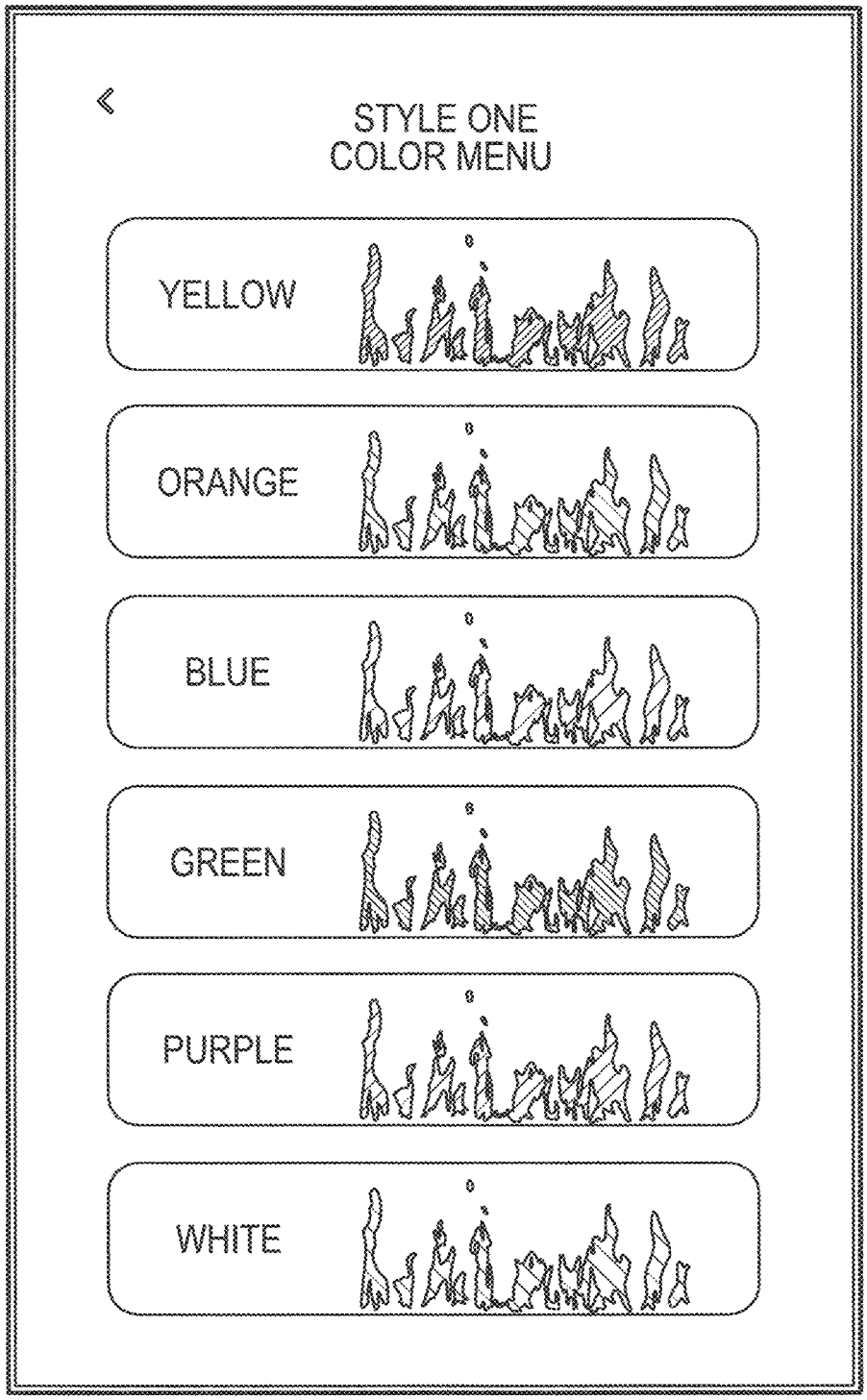
Figure 4C:
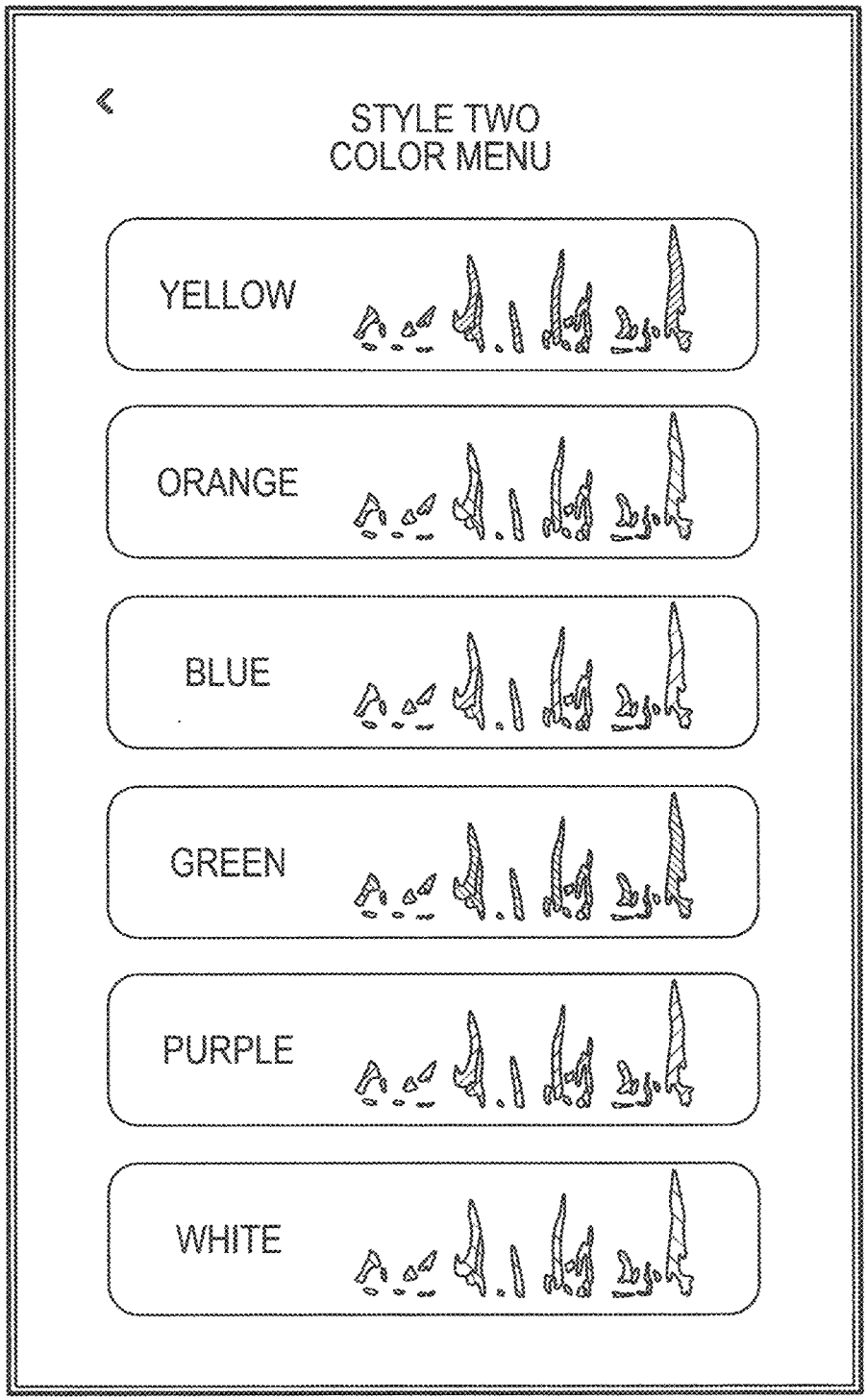
Figure 4D:
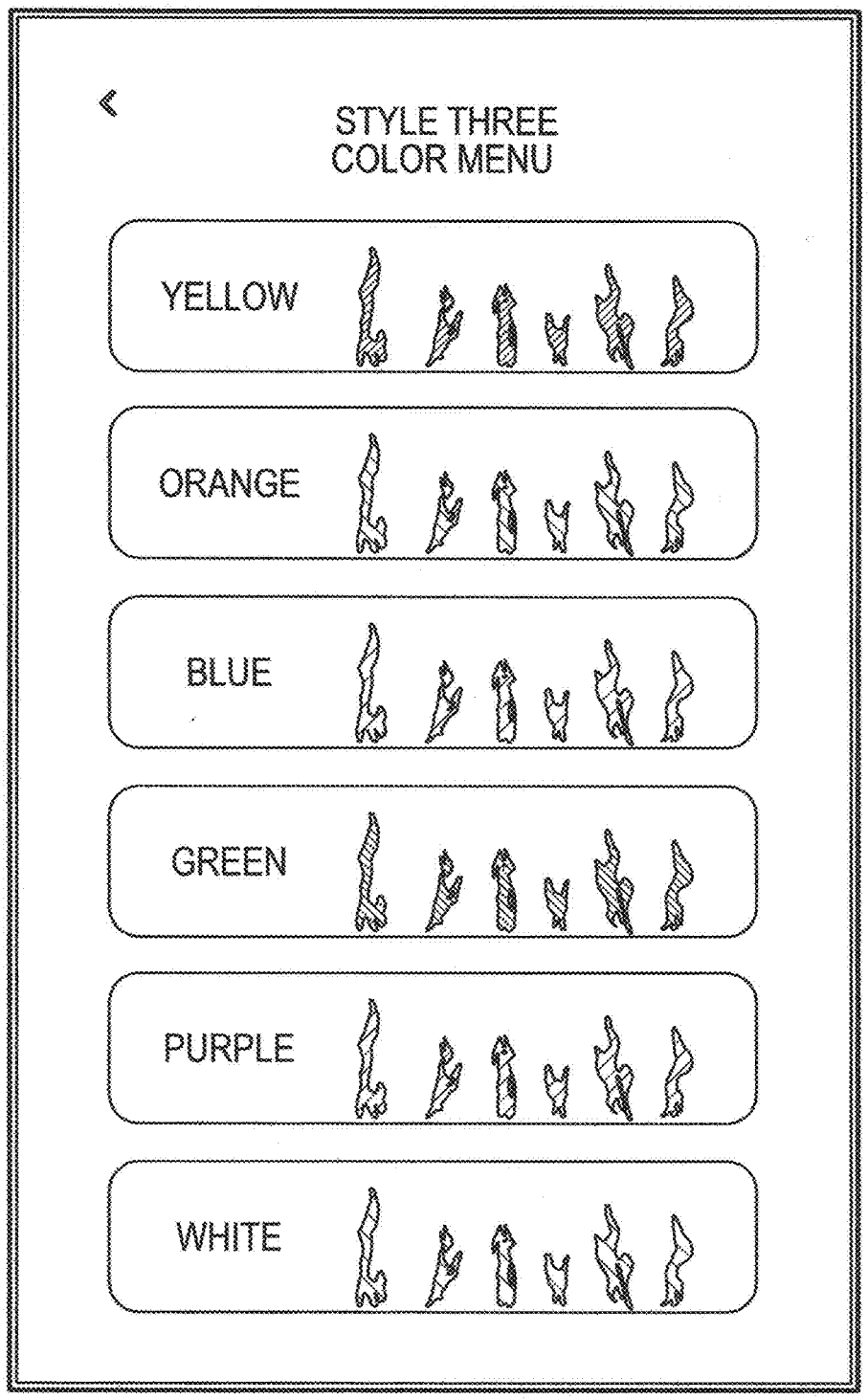

Referring to FIG. 3, there is illustrated the remote control 30 having display 31 operating based on an application. The display 31 displays a power on/off slider button at 40. A flame style option button 42 opens a flame sub-menu shown in FIG. 4A for selecting the flame style and color, shown as having three settings with six colors for each of the styles as shown in FIG. 4B-4D. A flame speed slider button 44 allows the user to change flame speed between three settings of current flame displayed, shown as slow, default and fast. A volume control slider button 46 allows the user to change a sound effect and volume, displayed as having a selection of off, default, medium and high. A down-lighting control button has an icon shown at 48 which opens a down-light sub-menu shown in FIG. 5 to allow the user to select the color and brightness of the down-lighting 26. An ember bed control button has an icon shown at 50 and opens up the same sub-menu shown in FIG. 5 to allow the user to select the color and brightness of the ember bed lighting 24. A heater button has an icon shown at 52 that opens a sub-menu shown in FIG. 6 for controlling the heat generated by the heater 36. A timer button has an icon shown at 54 that opens a sub-menu shown in FIG. 7 for controlling the time schedule for operating the fireplace 10. The sub-menu includes a set schedule button 70 that opens a weekly programming sub-menu shown in FIG. 8 that has individual seven-day options shown at 72. If a program is set for that day, the color tab is displayed on the ends of that day. Color keys 74 enable the control of the heater 32, the faux flames 16, and the recirculation using fan 36. The reset button allows the reset of all seven days of any programming.

Figure 9:
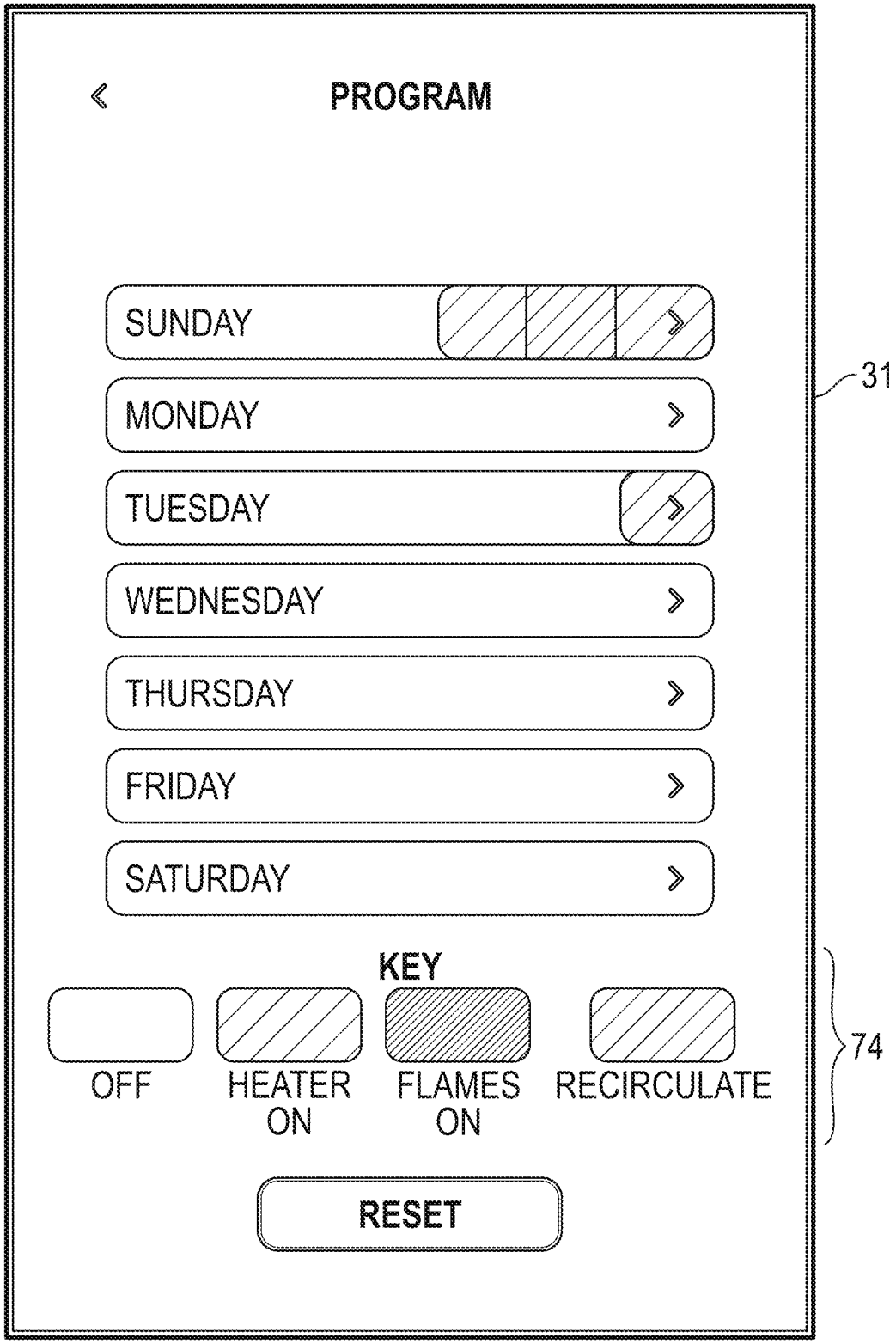
FIG. 9 illustrates Sunday being selected in the sub-menu of FIG. 8 to establish a programmable schedule for operating the faux flame, the heater and the blower.
Figure 10:
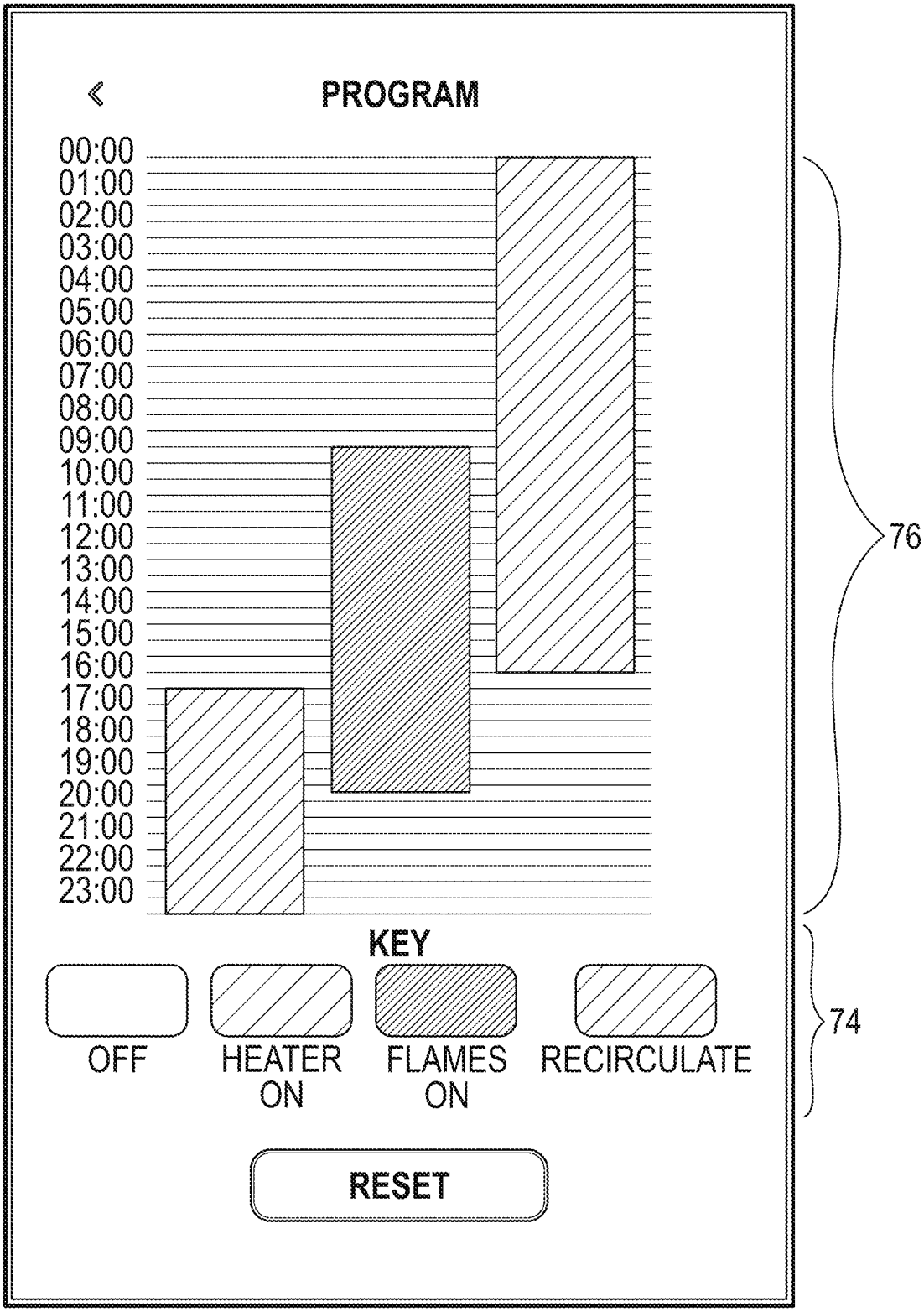
FIG. 10 illustrates an example programmed schedule for Sunday corresponding to the sub-menu of FIG. 9.

FIG. 9 illustrates the individual day programming button for Sunday selected, which upon selection opens the sub-menu illustrated in FIG. 10. After the user selects an option on key 74, a schedule 76 for Sunday can be programmed using remote control 30 by selecting the time of day for each option. In an example, FIG. 10 illustrates the heater 32 being on from 17:00 to 24:00, the faux flame 16 being on from 09:30 to 19:30, and the blower 38 being on from 00:00 to 16:00.

Figure 11:
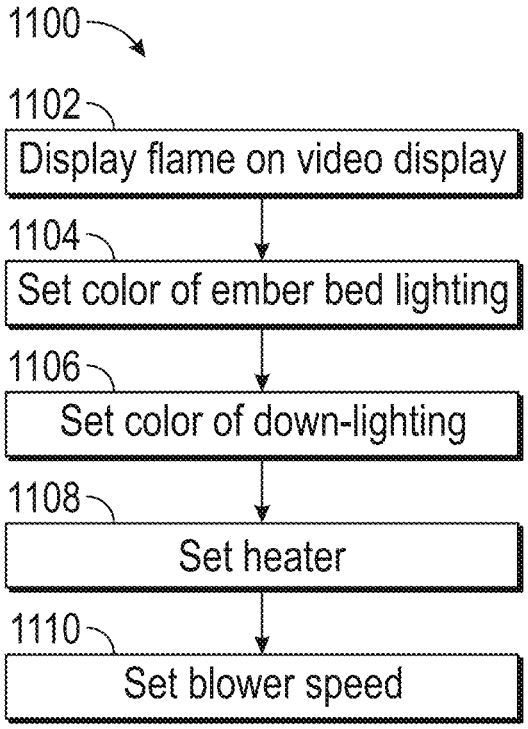
FIG. 11 illustrates a method of operating the faux fireplace.

Referring to FIG. 11, there is shown a method 1100 for operating the faux fireplace 10. The faux fireplace 10 can be manually controlled by the remote control 30, by the control panel 38, or automatically by the program schedule 76 executed by controller 28 as discussed.

At block 1102, the display 14 is selected to be on to generate the faux flame 16, either manually using a button of control panel 38, the remote control 30 as displayed in FIG. 3, or by the programmed schedule 76 as shown in FIG. 10. The color of the displayed faux flame 16 and the flame style is established using the sub-menu displayed by the remote control 30 on display 31 as shown in FIG. 4 or based on the programmed schedule.

Figure 5:
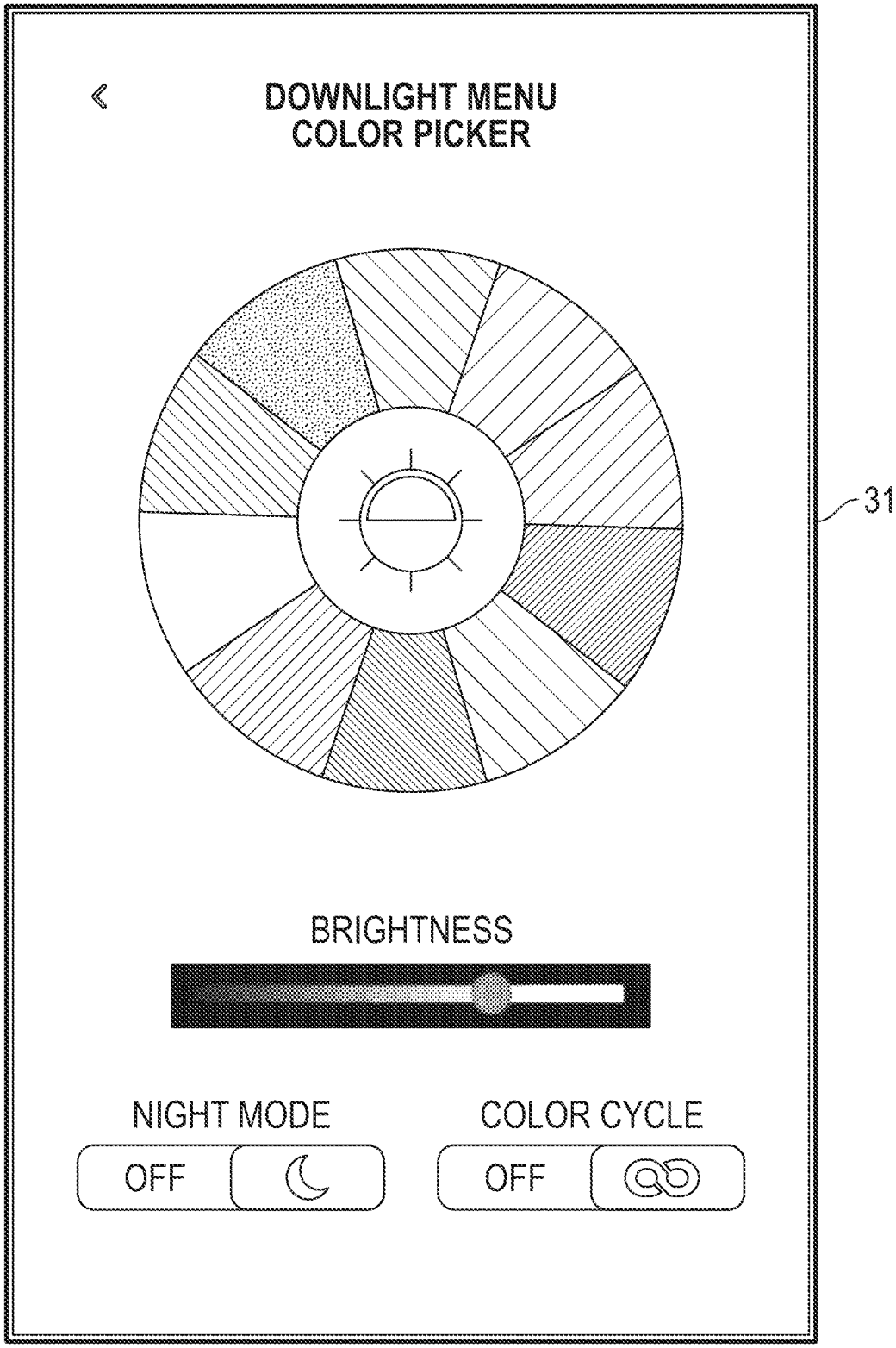
FIG. 5 illustrates a color picker menu for selecting the color of the ember bed lighting and the down-lighting.

At block 1104, the color of the ember bed lighting 24 is established using the sub-menu displayed by the remote control 30 on display 31 as shown in FIG. 5 or based on the programmed schedule.

At block 1106, the color of the down-lighting 26 is established using the sub-menu displayed by the remote control 30 on display 31 as shown in FIG. 5 or based on the programmed schedule.

Figure 6:
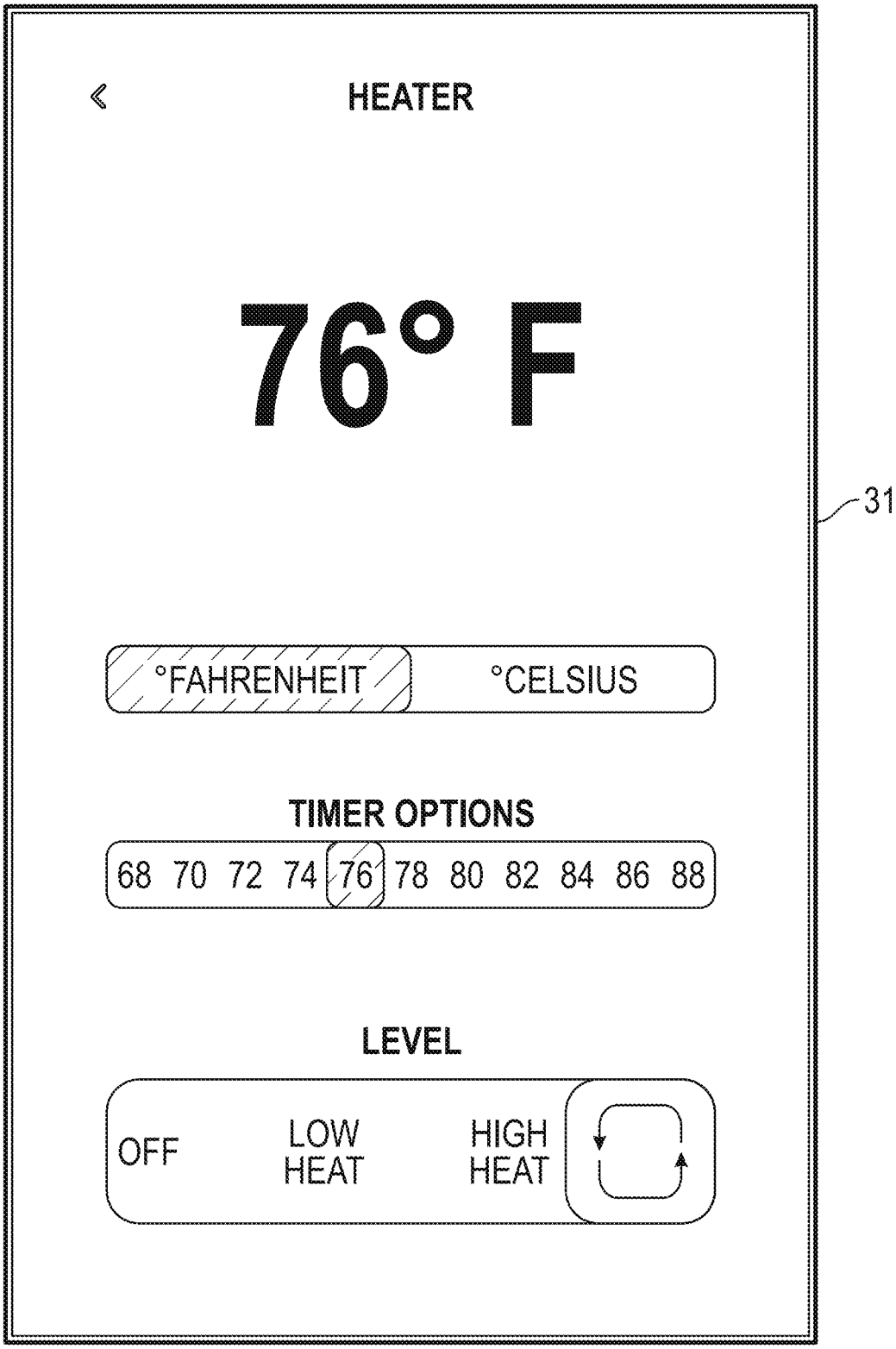
FIG. 6 illustrates a heater menu for selecting a heat setting of a firebox heater.

At block 1108, the heater 32 is controlled by the remote control 30 or the control panel 38 as shown in FIG. 6 or based on the programmed schedule.

Figure 7:
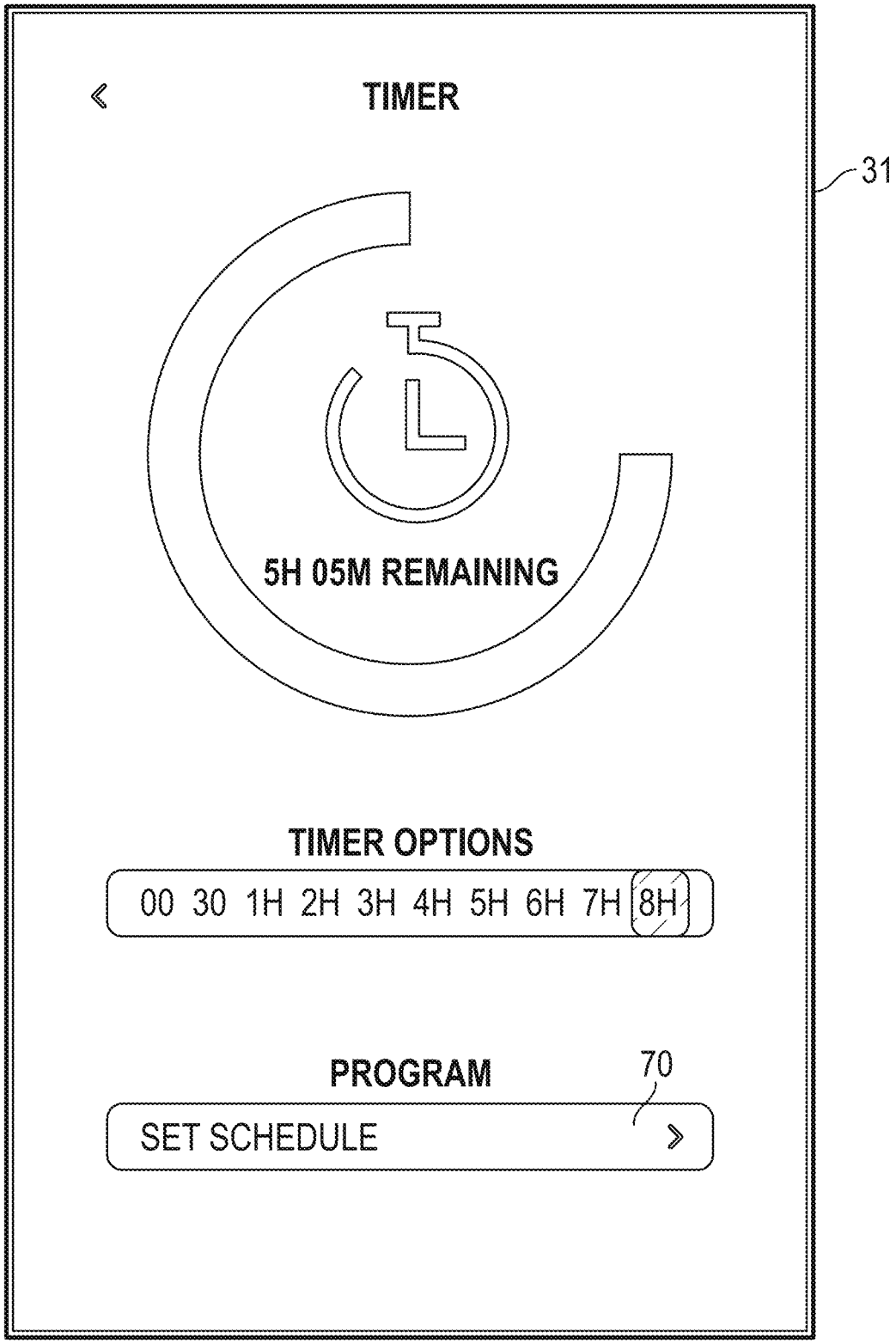
FIG. 7 illustrates the timer menu for selecting a time schedule for the displayed video faux flame, ember bedding and down-lighting.
Figure 8:
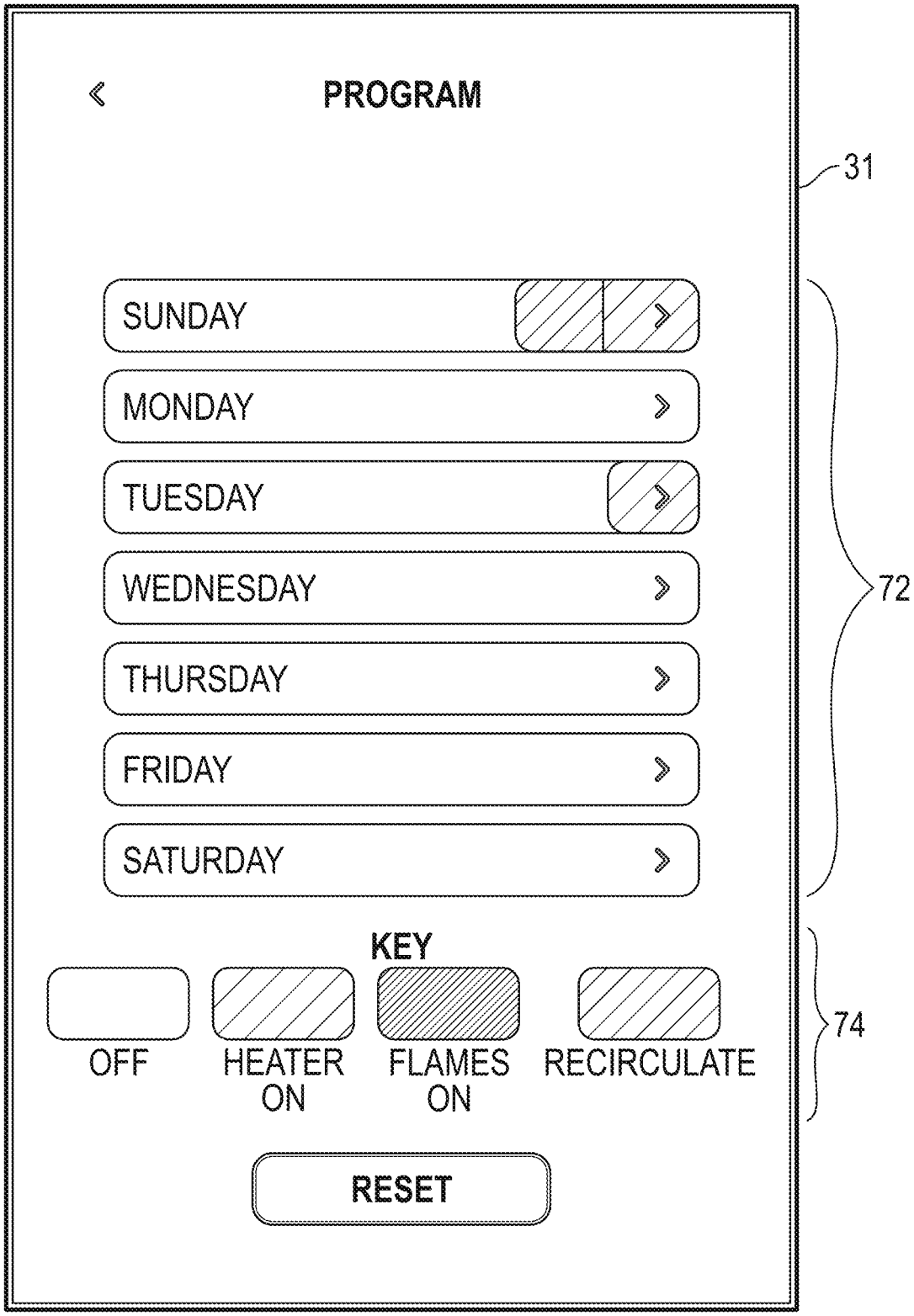
FIG. 8 illustrates a sub-menu enabling the programming of schedule.

At block 1110, the blower 36 is controlled by the remote control 30 as shown in FIG. 7 or based on the programmed schedule.

The appended claims set forth novel and inventive aspects of the subject matter described above, but the claims may also encompass additional subject matter not specifically recited in detail. For example, certain features, elements, or aspects may be omitted from the claims if not necessary to distinguish the novel and inventive features from what is already known to a person having ordinary skill in the art. Features, elements, and aspects described herein may also be combined or replaced by alternative features serving the same, equivalent, or similar purpose without departing from the scope of the invention defined by the appended claims.

What is claimed is:

1. A faux fireplace, comprising:

a firebox;

a display disposed in the firebox and configured to display a faux flame;

an ember bed disposed in the firebox in front of the display;

ember bed lighting configured to illuminate the ember bed in a plurality of colors;

down-lighting configured to illuminate the firebox from above the ember bed in a plurality of colors;

a control input; and a controller responsive to the control input and configured to control a color of the displayed faux flame, a color of the ember bed lighting, and a color of the down-lighting such that each are color synchronized to each other.

2. The faux fireplace as specified in claim 1, wherein the faux flame, the ember bed lighting, and the down-lighting each have the same color.

3. The faux fireplace as specified in claim 1, wherein the user input is configured to establish a flame style and a color of the displayed faux flame.

4. The faux fireplace as specified in claim 3, wherein the controller is configured to have a plurality of settings, each of the settings establishing the color of the faux flame, the color of the ember bed lighting, and the color of the down-lighting.

5. The faux fireplace as specified in claim 4, wherein each of the plurality of settings are configured to be selectively set by a user operating the control input.

6. The faux fireplace as specified in claim 1, wherein the controller is configured to operate according to a user selectable schedule.

7. The faux fireplace as specified in claim 6, wherein the faux fireplace further includes a heater configured to generate heat, and a blower configured to blow the generated heat.

8. The faux fireplace as specified in claim 7, wherein schedule is configured to control the displayed faux flame, the heater, and the blower.

9. The faux fireplace as specified in claim 8, wherein the schedule is configured to control when the faux flame is generated, when the heater is on, and when the blower is on.

10. The faux fireplace as specified in claim 1 wherein the controller is configured to establish a brightness and color of each the ember bed lighting and the down-lighting.

11. A method of operating a faux fireplace comprising a firebox, a display disposed in the firebox and configured to display a faux flame, an ember bed disposed in the firebox in front of the display, ember bed lighting configured to illuminate the ember bed in a plurality of colors, down-lighting configured to illuminate the firebox from above the ember bed in a plurality of colors, a control input, and a controller responsive to the control input and configured to control a color of the displayed faux flame, a color of the ember bed lighting, and a color of the down-lighting such that each are color synchronized to each other, comprising the steps of:

the controller controlling a color of the displayed faux flame, a color of the ember bed lighting, and a color of the down-lighting such that each are color synchronized to each other.

12. The method as specified in claim 11, wherein the faux flame, the ember bed lighting, and the down-lighting each have the same color.

13. The method as specified in claim 12, wherein the controller has a plurality of settings, each of the settings establishing the color of the faux flame, the color of the ember bed lighting, and the color of the down-lighting.

14. The method as specified in claim 13, wherein each of the plurality of settings are configured to be selectively set by a user operating the control input.

15. The method as specified in claim 11, wherein the user input establishes a flame style and a color of the displayed faux flame.

16. The method as specified in claim 11, wherein the controller operates according to a user selectable schedule.

17. The method as specified in claim 16, wherein the faux fireplace further includes a heater generating heat, and a blower blowing the generated heat.

18. The method as specified in claim 17, wherein schedule controls the displayed faux flame, the heater, and the blower.

19. The method as specified in claim 18, wherein the schedule controls when the faux flame is generated, when the heater is on, and when the blower is on.

20. The method as specified in claim 11 wherein the controller establishes a brightness and color of each the ember bed lighting and the down-lighting.

* * * * *